US010965005B2

(12) United States Patent
Huang et al.

(10) Patent No.: US 10,965,005 B2
(45) Date of Patent: Mar. 30, 2021

(54) COMMUNICATION DEVICE AND ANTENNA STRUCTURE

(71) Applicant: Wistron NeWeb Corp., Hsinchu (TW)

(72) Inventors: Chun-Lin Huang, Hsinchu (TW); Chien-Ting Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 36 days.

(21) Appl. No.: 16/682,010

(22) Filed: Nov. 13, 2019

(65) Prior Publication Data

US 2020/0287273 A1 Sep. 10, 2020

(30) Foreign Application Priority Data

Mar. 5, 2019 (TW) ..... 108107200

(51) Int. Cl.

| | |
|---|---|
| ***H01Q 21/00*** | (2006.01) |
| ***H01Q 1/24*** | (2006.01) |
| ***H01Q 9/26*** | (2006.01) |
| ***H01Q 1/42*** | (2006.01) |
| ***H01Q 9/30*** | (2006.01) |
| ***H01Q 5/307*** | (2015.01) |

(52) U.S. Cl.

CPC ..... *H01Q 1/24* (2013.01); *H01Q 1/42* (2013.01); *H01Q 5/307* (2015.01); *H01Q 9/26* (2013.01); *H01Q 9/30* (2013.01); *H01Q 21/00* (2013.01)

(58) Field of Classification Search

CPC ..... H01Q 21/00; H01Q 1/24; H01Q 9/26; H01Q 1/42; H01Q 9/30; H01Q 5/307

USPC ..... 343/725, 713, 715, 702, 895

See application file for complete search history.

(56) References Cited

U.S. PATENT DOCUMENTS

| | | | | |
|---|---|---|---|---|
| 4,504,836 | A | 3/1985 | Seavey | |
| 5,949,383 | A | 9/1999 | Hayes et al. | |
| 7,515,109 | B2 | 4/2009 | Wei | |
| 2017/0207542 | A1* | 7/2017 | Tseng | H01Q 13/106 |

FOREIGN PATENT DOCUMENTS

| | | | |
|---|---|---|---|
| TW | 200733478 | A | 9/2007 |
| TW | M401878 | U | 4/2011 |

* cited by examiner

*Primary Examiner* — Joseph J Lauture

(74) *Attorney, Agent, or Firm* — McClure, Qualey & Rodack, LLP

(57) ABSTRACT

A communication device includes a nonconductive housing, a cable, an antenna structure, and a signal source. The nonconductive housing has a hollow structure. The cable is coupled to the signal source. The cable includes a signaling conductor and a grounding conductor. The antenna structure includes an antenna body and an enclosed radiation element. The antenna body is coupled to the signaling conductor. The antenna body is disposed outside the nonconductive housing. The enclosed radiation element is coupled to the grounding conductor. The enclosed radiation element is disposed inside the nonconductive housing.

20 Claims, 8 Drawing Sheets

COMMUNICATION DEVICE AND ANTENNA STRUCTURE

CROSS REFERENCE TO RELATED APPLICATIONS

This application claims priority of Taiwan Patent Application No. 108107200 filed on Mar. 5, 2019, the entirety of which is incorporated by reference herein.

BACKGROUND OF THE INVENTION

Field of the Invention

The disclosure generally relates to a communication device, and more particularly, it relates to a communication device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the Internet at high speeds. However, since indoor environments have serious problems with signal reflection and multipath fading, wireless access points should process signals in a variety of polarization directions and from a variety of transmission directions simultaneously. Accordingly, it has become a critical challenge for current designers to design an antenna having multiple polarization directions in the limited space of a wireless access point.

BRIEF SUMMARY OF THE INVENTION

In an exemplary embodiment, the disclosure is directed to a communication device which includes a nonconductive housing, a cable, an antenna structure, and a signal source. The nonconductive housing has a hollow structure. The cable is coupled to the signal source. The cable includes a signaling conductor and a grounding conductor. The antenna structure includes an antenna body and an enclosed radiation element. The antenna body is coupled to the signaling conductor. The antenna body is disposed outside the nonconductive housing. The enclosed radiation element is coupled to the grounding conductor. The enclosed radiation element is disposed inside the nonconductive housing.

In some embodiments, the enclosed radiation element substantially has a straight-line shape.

In some embodiments, the angle between the antenna body and the enclosed radiation element is from 0 to 180 degrees.

In some embodiments, the antenna structure covers a low-frequency band and a high-frequency band. The low-frequency band is from 700 MHz to 960 MHz. The high-frequency band is from 1700 MHz to 2700 MHz.

In some embodiments, the antenna body is classified as a folded dipole antenna.

In some embodiments, the distance between the antenna body and the enclosed radiation element is shorter than or equal to 3 wavelengths of the low-frequency band.

In some embodiments, the antenna body includes a connection radiation element, a main radiation element, a first meandering radiation element, and a second meandering radiation element. The connection radiation element is coupled to a positive feeding point. The main radiation element is coupled to the connection radiation element. The first meandering radiation element is coupled to a negative feeding point. The second meandering radiation element is coupled to the negative feeding point. The connection radiation element is positioned between the first meandering radiation element and the second meandering radiation element.

In some embodiments, the connection radiation element, the first meandering radiation element, and the second meandering radiation element have a symmetrical pattern.

In some embodiments, the connection radiation element has a variable-width straight-line shape.

In some embodiments, the first meandering radiation element surrounds a first nonconductive region, and the second meandering radiation element surrounds a second nonconductive region.

In some embodiments, the main radiation element has an asymmetrical pattern.

In some embodiments, the main radiation element has a rectangular notch.

In some embodiments, the length of the antenna body is substantially equal to 0.25 wavelength of the low-frequency band.

In some embodiments, the length of the enclosed radiation element is greater than 3 times the width of the antenna body.

In some embodiments, the length of the antenna body is greater than 7 times the width of the antenna body.

In some embodiments, the sum of the length of the antenna body and the length of the enclosed radiation element is substantially equal to 0.4 wavelength of the low-frequency band.

In some embodiments, the sum of the length of the main radiation element and the length of the enclosed radiation element is substantially equal to 0.6 wavelength of the high-frequency band.

In some embodiments, the antenna structure further includes a connector. The cable is coupled through the connector to the antenna body and the enclosed radiation element.

In some embodiments, the antenna structure further includes a nonconductive antenna cover. The antenna body is disposed inside the nonconductive antenna cover.

In another exemplary embodiment, the disclosure is directed to an antenna structure which includes an antenna body and an enclosed radiation element. The antenna body is coupled to a positive electrode of a signal source. The enclosed radiation element is coupled to a negative electrode of the signal source. The antenna structure covers a low-frequency band and a high-frequency band. The sum of the length of the antenna body and the length of the enclosed radiation element is substantially equal to 0.4 wavelength of the low-frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
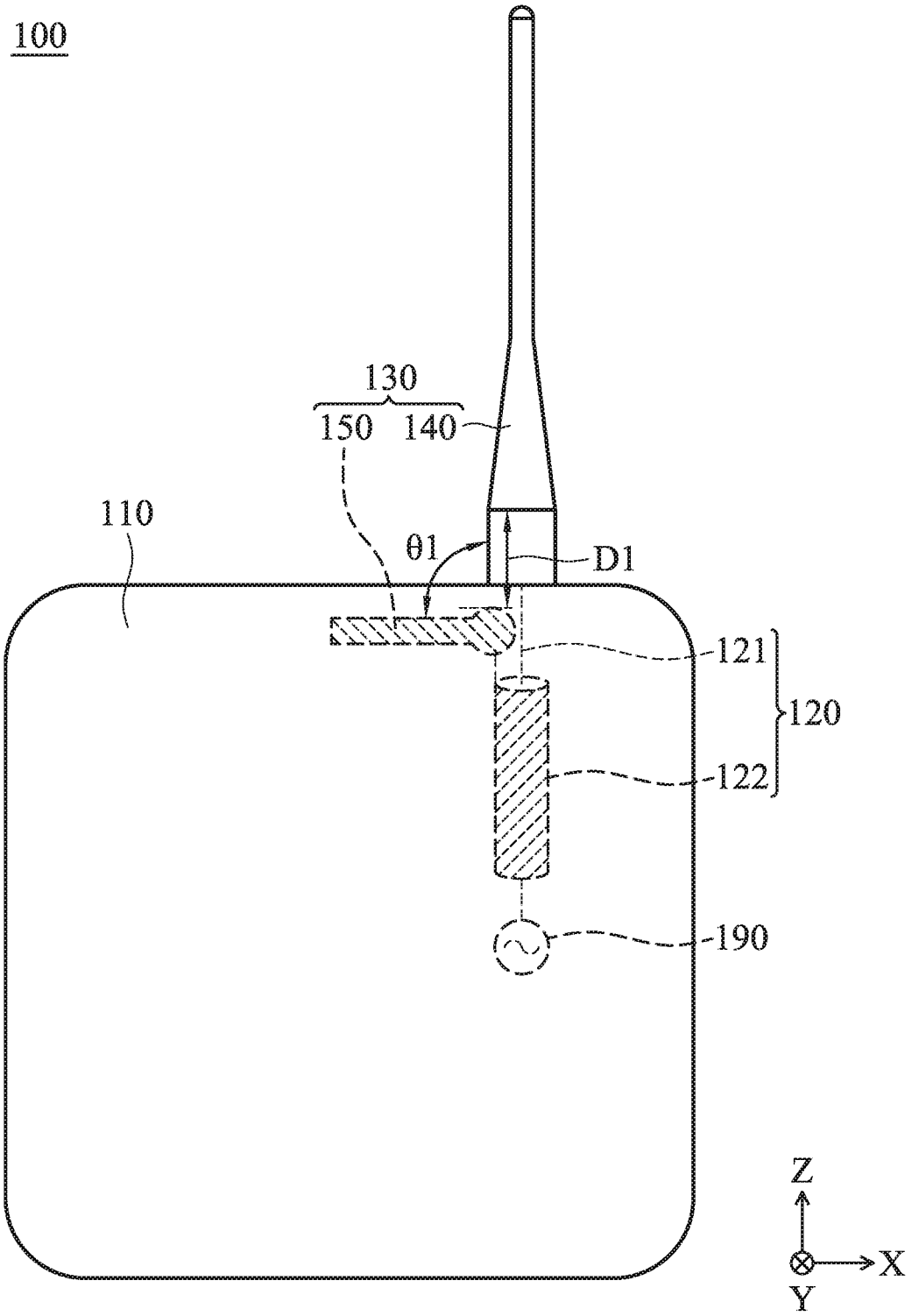
FIG. 1 is a perspective view of a communication device according to an embodiment of the invention.

FIG. 1 is a perspective view of a communication device 100 according to an embodiment of the invention. For example, the communication device 100 may be a wireless access point. As shown in FIG. 1, the communication device 100 includes a nonconductive housing 110, a cable 120, an antenna structure 130, and a signal source 190. It should be understood that the communication device 100 may further include other components, such as a PCB (Printed Circuit Board), an electronic component, a connector, an antenna cover, a processor, and a power supply module, although they are not displayed in FIG. 1.

The nonconductive housing 110 has a hollow structure for accommodating a variety of elements. The shape and style of the nonconductive housing 110 are not limited in the invention. For example, the nonconductive housing 110 may be a hollow cube. The cable 120 is coupled to the signal source 190. For example, the cable 120 may be a coaxial cable or any type of a transmission line. The cable 120 includes a signaling conductor 121 and a grounding conductor 122. The antenna structure 130 includes an antenna body 140 and an enclosed radiation element 150. The antenna body 140 is disposed outside the nonconductive housing 110. The enclosed radiation element 150 is disposed inside the nonconductive housing 110. In other words, the antenna body 140 is a portion which can be directly observed by eyes of a user, but the enclosed radiation element 150 is another portion which cannot be seen by the eyes of the user (blocked by the nonconductive housing 110). The signal source 190 may be an RF (Radio Frequency) module for exciting the antenna structure 130. In some embodiments, the signal source 190 has a positive electrode and a negative electrode. The positive electrode of the signal source 190 is coupled through the signaling conductor 121 to the antenna body 140. The negative electrode of the signal source 190 is coupled through the grounding conductor 122 to the enclosed radiation element 150. In alternative embodiments, the positive electrode and the negative electrode of the signal source 190 are exchanged with each other, without affecting the performance of the invention.

In some embodiments, the antenna structure 130 covers a low-frequency band and a high-frequency band. The low-frequency band may be from 700 MHz to 960 MHz. The high-frequency band may be from 1700 MHz to 2700 MHz. Accordingly, the antenna structure 130 can support at least the wideband operations of LTE (Long Term Evolution). In alternative embodiments, the low-frequency band is from 2400 MHz to 2500 MHz, and the high-frequency band is from 5150 MHz to 5850 MHz, such that the antenna structure 130 can support the dual-band operations of WLAN (Wireless Local Area Networks) 2.4 GHz/5 GHz.

The shape and type of the antenna body 140 are not limited in the invention. For example, the antenna body 140 may be a monopole antenna, a dipole antenna, a patch antenna, a PIFA (Planar Inverted F Antenna), or a chip antenna. The enclosed radiation element 150 may be made of a conductive material, such as a metal material. The enclosed radiation element 150 may substantially have a straight-line shape, such as a long iron element, but it is not limited thereto. In alternative embodiments, the enclosed radiation element 150 has a meandering shape, such as an L-shape, a Z-shape, or an arc-shape. The angle $\theta 1$ between the antenna body 140 and the enclosed radiation element 150 may be from 0 to 180 degrees, such as 90 degrees. Generally, the enclosed radiation element 150 and the antenna body 140 can generate resonant currents in different directions corresponding to different polarization directions. For example, if the antenna body 140 has a vertical polarization direction, the enclosed radiation element 150 can provide a horizontal polarization direction, so as to compensate for the nulls of the radiation pattern of the antenna body 140. In order to enhance the coupling effect between the antenna body 140 and the enclosed radiation element 150, the distance D1 between the antenna body 140 and the enclosed radiation element 150 may be shorter than or equal to 3 wavelengths ($3\lambda$) of the low-frequency band of the antenna structure 130. It should be noted that the enclosed radiation element 150 is considered as an extension portion of the antenna body 140. Since the enclosed radiation element 150 is disposed inside the nonconductive housing 110, it does not additionally increase the total size of the antenna body 140, and it can also improve the visual appearance of the communication device 100. With such a design, the antenna structure 130 including the antenna body 140 and the enclosed radiation element 150 has at least the advantages of small size, wide bandwidth, and multiple polarization directions, and therefore it is suitable for application in a variety of communication devices 100.

The following embodiments will introduce a variety of detailed features of the communication device 100 and its antenna structure 130. It should be understood that these figures and descriptions are merely exemplary, rather than limitations of the invention.

Figure 2:
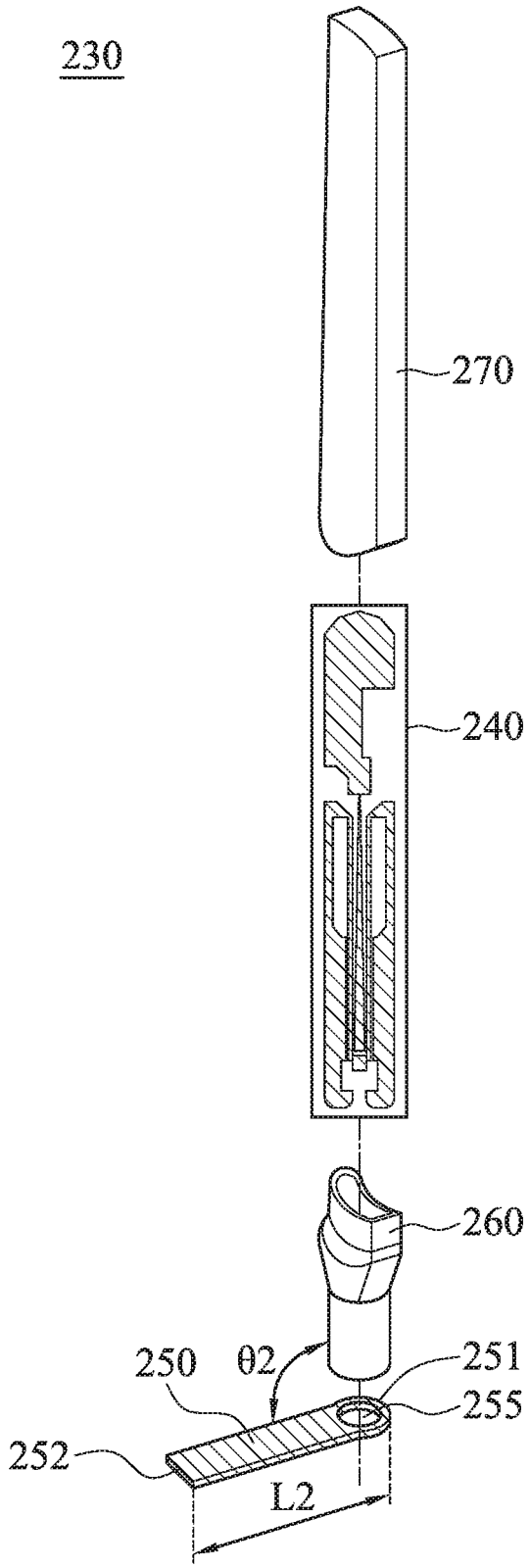
FIG. 2 is an exploded view of an antenna structure according to an embodiment of the invention.

FIG. 2 is an exploded view of an antenna structure 230 according to an embodiment of the invention. In the embodiment of FIG. 2, the antenna structure 230 includes an antenna body 240, an enclosed radiation element 250, a connector 260, and a nonconductive antenna cover 270. The antenna body 240 may be classified as a folded dipole antenna, which will be described in detail for the embodiment of FIG. 3. The enclosed radiation element 250 may substantially have a straight-line shape. The enclosed radiation element 250 has a first end 251 and a second end 252. An opening 255 is formed at the first end 251 of the enclosed radiation element 250. The second end 252 of the enclosed radiation element 250 is an open end. The aforementioned cable 120 may pass through the opening 255 of the enclosed radiation element 250, so as to simplify the relative assembling process. For example, the opening 255 of the enclosed radiation element 250 may substantially have a circular shape, an elliptical shape, a triangular shape, or a square shape. In alternative embodiments, the opening 255 of the enclosed radiation element 250 is full of a conductive material. The connector 260 may be any type, such as an SMA (SubMiniature version A) connector, but it is not limited thereto. The signaling conductor 121 of the cable 120 may be coupled through a signaling portion of the connector 260 to the antenna body 240. The grounding conductor 122 of the cable 120 may be coupled through a grounding portion of the connector 260 to the enclosed radiation element 250 (not shown). Similarly, the angle θ2 between the enclosed radiation element 250 and the antenna body 240 (or the connector 260) may be from 0 to 180 degrees, such as 90 degrees. The nonconductive antenna cover 270 has a bottom opening and a hollow portion connected thereto. The antenna body 240 may be disposed inside the nonconductive antenna cover 270. The nonconductive antenna cover 270 can provide the function of waterproof and dustproof, so as to protect the antenna body 240 from being damaged. It should be understood that the connector 260 and the nonconductive antenna cover 270 are optional elements, which are omitted in other embodiments.

Figure 3:
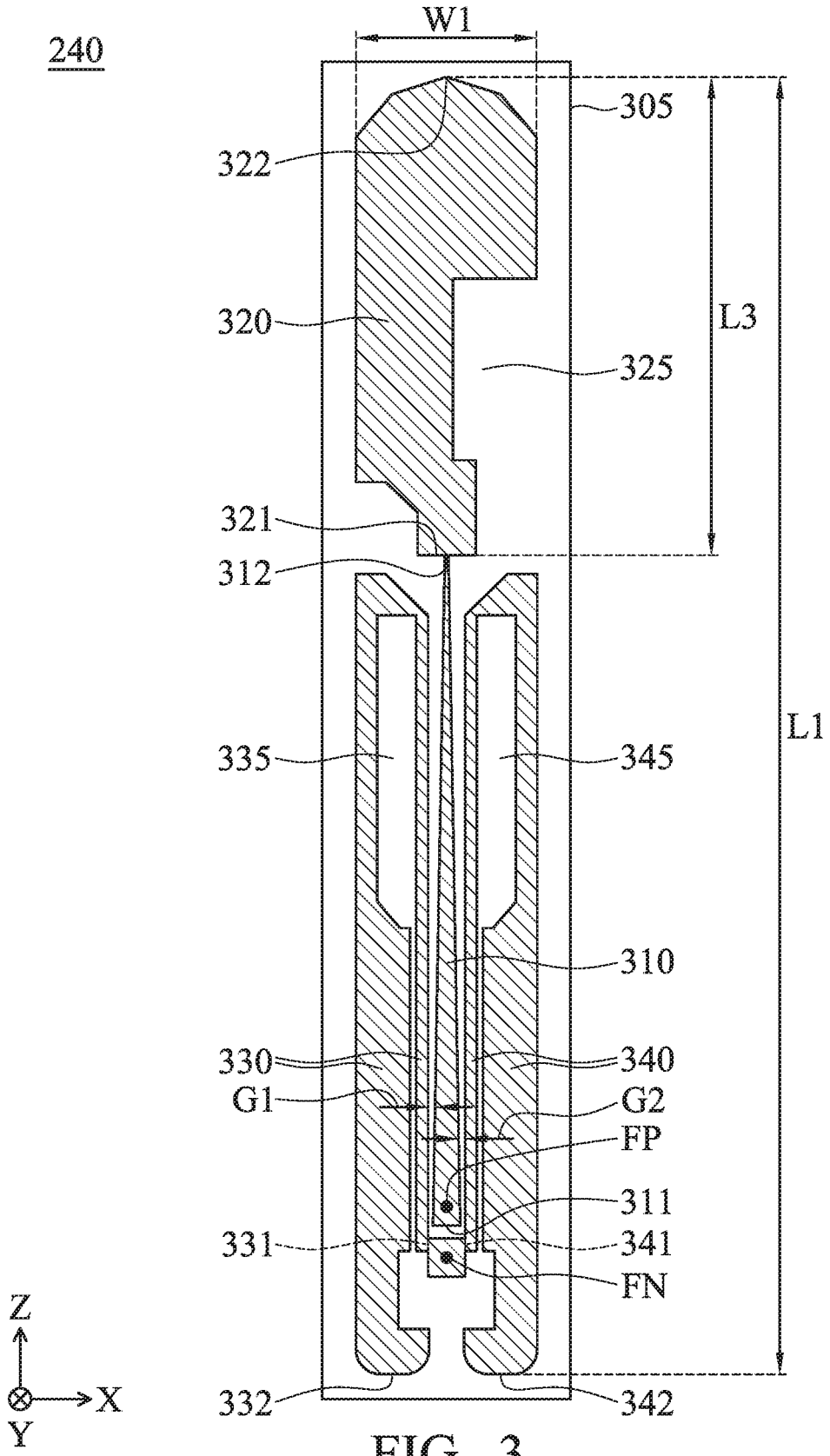
FIG. 3 is a view of an antenna body according to an embodiment of the invention.

FIG. 3 is a view of the antenna body 240 according to an embodiment of the invention. The antenna body 240 may be disposed on a dielectric substrate 305, such as an FR4 (Flame Retardant 4) substrate or an FPC (Flexible Circuit Board). In the embodiment of FIG. 3, the antenna body 240 includes a connection radiation element 310, a main radiation element 320, a first meandering radiation element 330, and a second meandering radiation element 340. The connection radiation element 310 may substantially have a variable-width straight-line shape. The connection radiation element 310 has a first end 311 and a second end 312, and the width of the first end 311 is greater than the width of the second end 312, so as to fine-tune the feeding impedance matching of the antenna body 240. The first end 311 of the connection radiation element 310 is coupled to a positive feeding point FP. The positive feeding point FP may be further coupled to the signaling conductor 121 of the cable 120. The main radiation element 320 may have an asymmetrical pattern. The main radiation element 320 has a first end 321 and a second end 322. The first end 321 of the main radiation element 320 is coupled to the second end 312 of the connection radiation element 310. The second end 322 of the main radiation element 320 is an open end, which substantially has an arc-shape. A side of the main radiation element 320 (e.g., the right side) has a rectangular notch 325, which is arranged for fine-tuning the high-frequency impedance matching of the antenna body 240. The connection radiation element 310, the first meandering radiation element 330, and the second meandering radiation element 340 have a symmetrical pattern. The connection radiation element 310 is positioned between the first meandering radiation element 330 and the second meandering radiation element 340. A first gap G1 is formed between the connection radiation element 310 and the first meandering radiation element 330. A second gap G2 is formed between the connection radiation element 310 and the second meandering radiation element 340. Thus, the connection radiation element 310 is not directly connected to the first meandering radiation element 330 and the second meandering radiation element 340. The first meandering radiation element 330 has a first end 331 and a second end 332. The first end 331 of the first meandering radiation element 330 is coupled to a negative feeding point FN. The second end 332 of the first meandering radiation element 330 is an open end. The second meandering radiation element 340 has a first end 341 and a second end 342. The first end 341 of the second meandering radiation element 340 is coupled to the negative feeding point FN. The second end 342 of the second meandering radiation element 340 is an open end. The second end 332 of the first meandering radiation element 330 and the second end 342 of the second meandering radiation element 340 may substantially extend in the same direction. The negative feeding point FN may be further coupled to the enclosed radiation element 250 and the grounding conductor 122 of the cable 120. In some embodiments, the enclosed radiation element 250 is directly coupled to the negative feeding point FN without communicating through the cable 120. The first meandering radiation element 330 surrounds a first nonconductive region 335. The second meandering radiation element 340 surrounds a second nonconductive region 345. Each of the first nonconductive region 335 and the second nonconductive region 345 may substantially have a rectangular shape or a straight-line shape. The first nonconductive region 335 and the second nonconductive region 345 may be substantially parallel to each other. The structure designs of the first meandering radiation element 330 and the second meandering radiation element 340 are configured to minimize the total size of the antenna body 240.

In some embodiments, the antenna structure 230 covers a low-frequency band and a high-frequency band. For example, the low-frequency band may be from 700 MHz to 960 MHz, and the high-frequency band may be from 1700 MHz to 2700 MHz, but they are not limited thereto. With respect to the antenna principles, the aforementioned low-frequency band is mainly generated by exciting the connection radiation element 310, the main radiation element 320, the first meandering radiation element 330, and the second meandering radiation element 340; furthermore, the aforementioned high-frequency band is mainly generated by exciting the main radiation element 320. According to practical measurements, the enclosed radiation element 250 has relatively high current density thereon, regardless of the low-frequency band or the high-frequency band. In other words, the enclosed radiation element 250 is configured to guide the low-frequency resonant currents and the high-frequency resonant currents, so as to provide different polarization directions and eliminate nulls of the radiation pattern. Accordingly, the radiation performance of the antenna structure 230 using the enclosed radiation element 250 is significantly improved.

In some embodiments, the element sizes of the antenna structure 230 are described as follows. The length L1 of the antenna body 240 may be substantially equal to 0.25 wavelength of the low-frequency band of the antenna structure 230 (i.e., L1=0.25λ). The length L2 of the enclosed radiation element 250 may be greater than 3 times the width W1 of the antenna body 240 (i.e., L2:W1>3:1). The length L1 of the antenna body 240 may be greater than 7 times the width W1 of the antenna body 240 (i.e., L1:W1>7:1). The sum of the length L1 of the antenna body 240 and the length L2 of the enclosed radiation element 250 may be substantially equal to 0.4 wavelength of the low-frequency band of the antenna structure 230. (i.e., L1+L2=0.4λ). The sum of the length L3 of the main radiation element 320 and the length L2 of the enclosed radiation element 250 may be substantially equal to 0.6 wavelength of the high-frequency band of the antenna structure 230. (i.e., L2+L3=0.6λ). The width of each of the first gap G1 and the second gap G2 may be smaller than 0.5 mm. The above ranges of element sizes are calculated and obtained according to many experiment results, and they help to optimize the radiation pattern and impedance matching of the antenna structure 230.

Figure 4A:
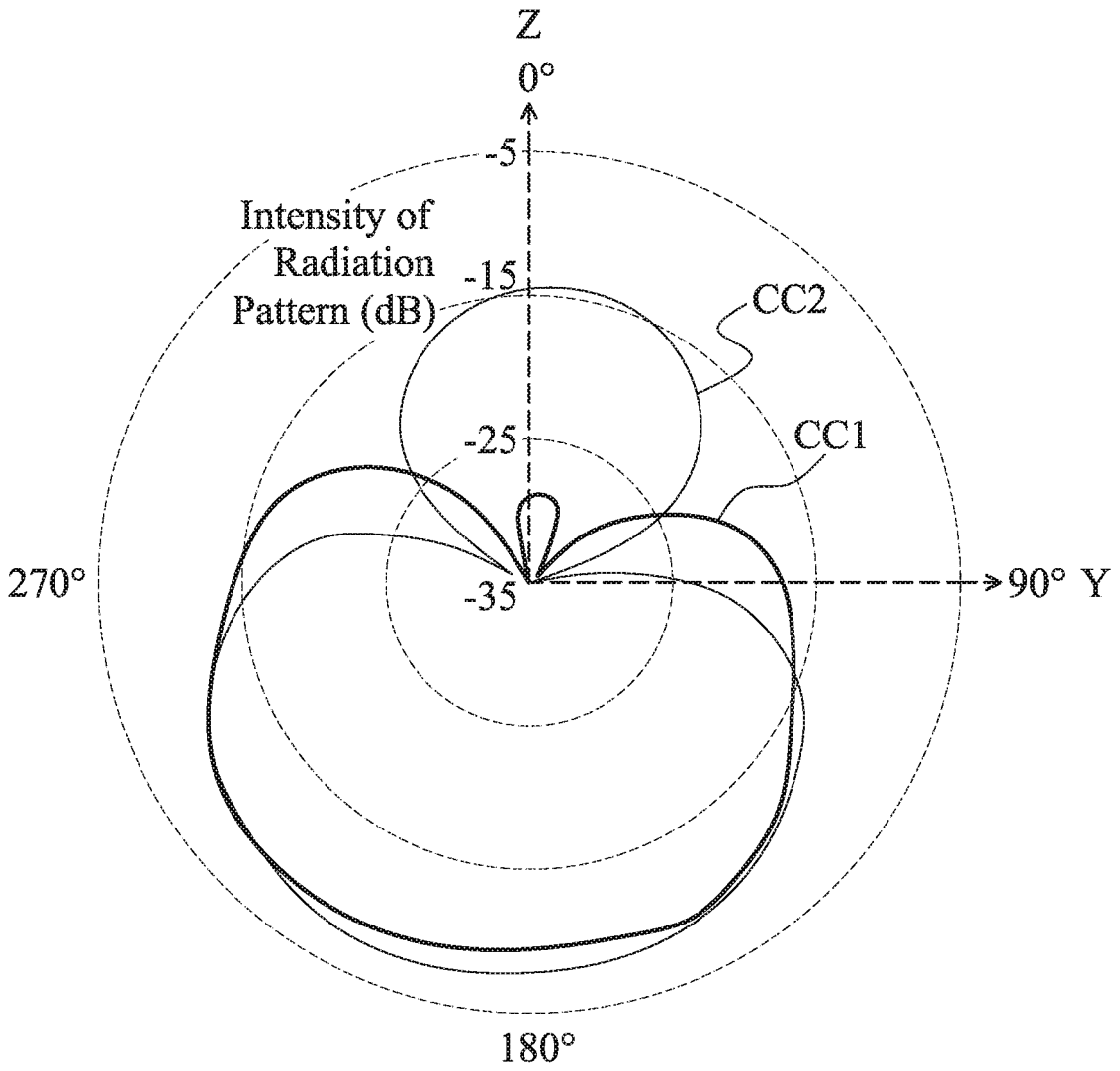
FIG. 4A is a radiation pattern of an antenna structure operating in a low-frequency band according to an embodiment of the invention.

FIG. 4A is a radiation pattern of the antenna structure 230 operating in the low-frequency band according to an embodiment of the invention (e.g., it may be measured on the YZ-plane). A first curve CC1 represents the radiation pattern of the antenna structure 230 without the enclosed radiation element 250. A second curve CC2 represents the radiation pattern of the antenna structure 230 with the enclosed radiation element 250. According to the measurements of FIG. 4A, the incorporation of the enclosed radiation element 250 can enhance the intensity of the radiation pattern of the antenna structure 230 by about 20 dB over the +Z-axis. Such a design can eliminate the nulls of the low-frequency radiation pattern of the antenna structure 230.

Figure 4B:
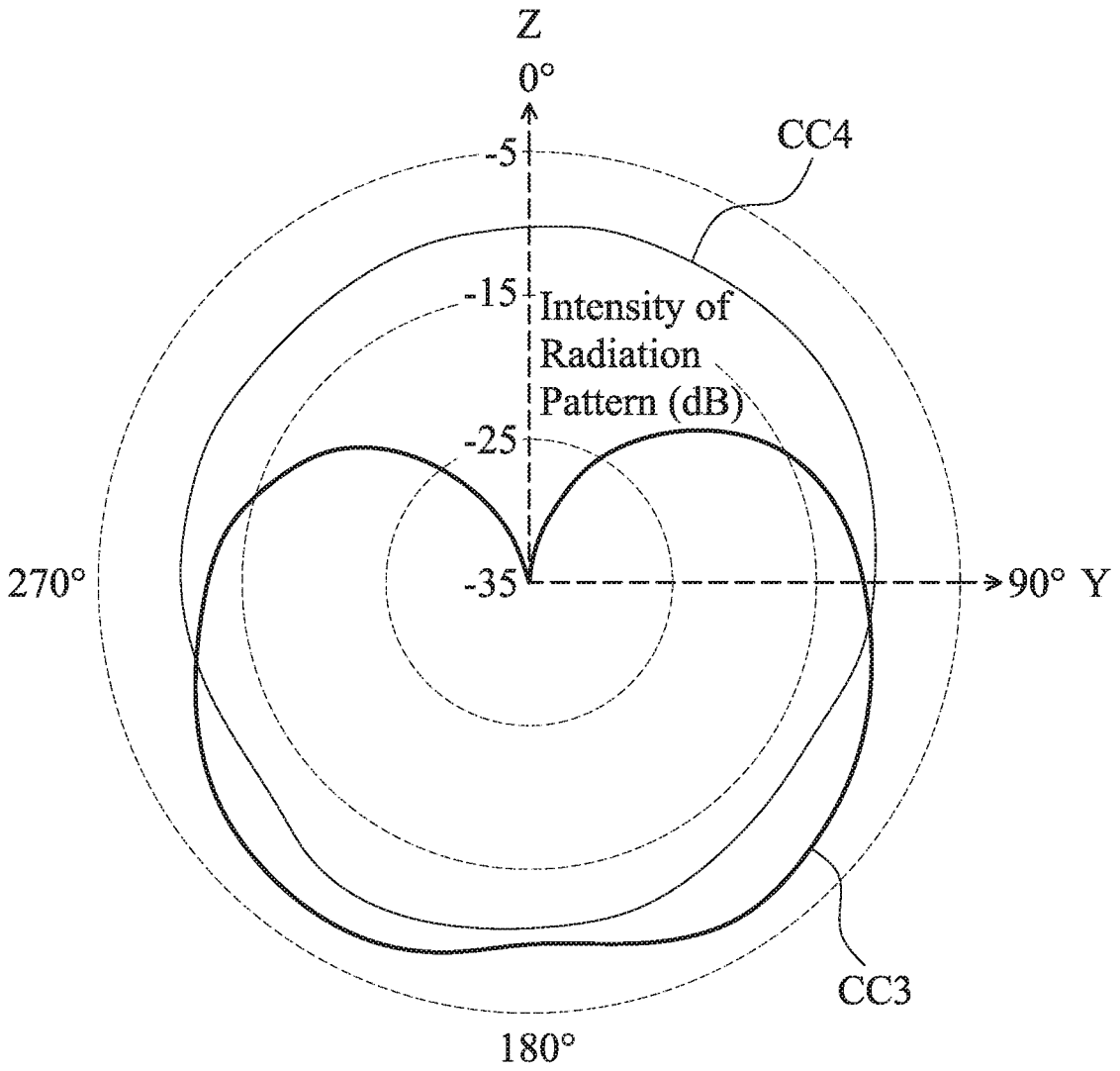
FIG. 4B is a radiation pattern of an antenna structure operating in a high-frequency band according to an embodiment of the invention.

FIG. 4B is a radiation pattern of the antenna structure 230 operating in the high-frequency band according to an embodiment of the invention (e.g., it may be measured on the YZ-plane). A third curve CC3 represents the radiation pattern of the antenna structure 230 without the enclosed radiation element 250. A fourth curve CC4 represents the radiation pattern of the antenna structure 230 with the enclosed radiation element 250. According to the measurements of FIG. 4B, the incorporation of the enclosed radiation element 250 can enhance the intensity of the radiation pattern of the antenna structure 230 by about 25 dB over the +Z-axis. Such a design can eliminate the nulls of the high-frequency radiation pattern of the antenna structure 230.

Figure 5:
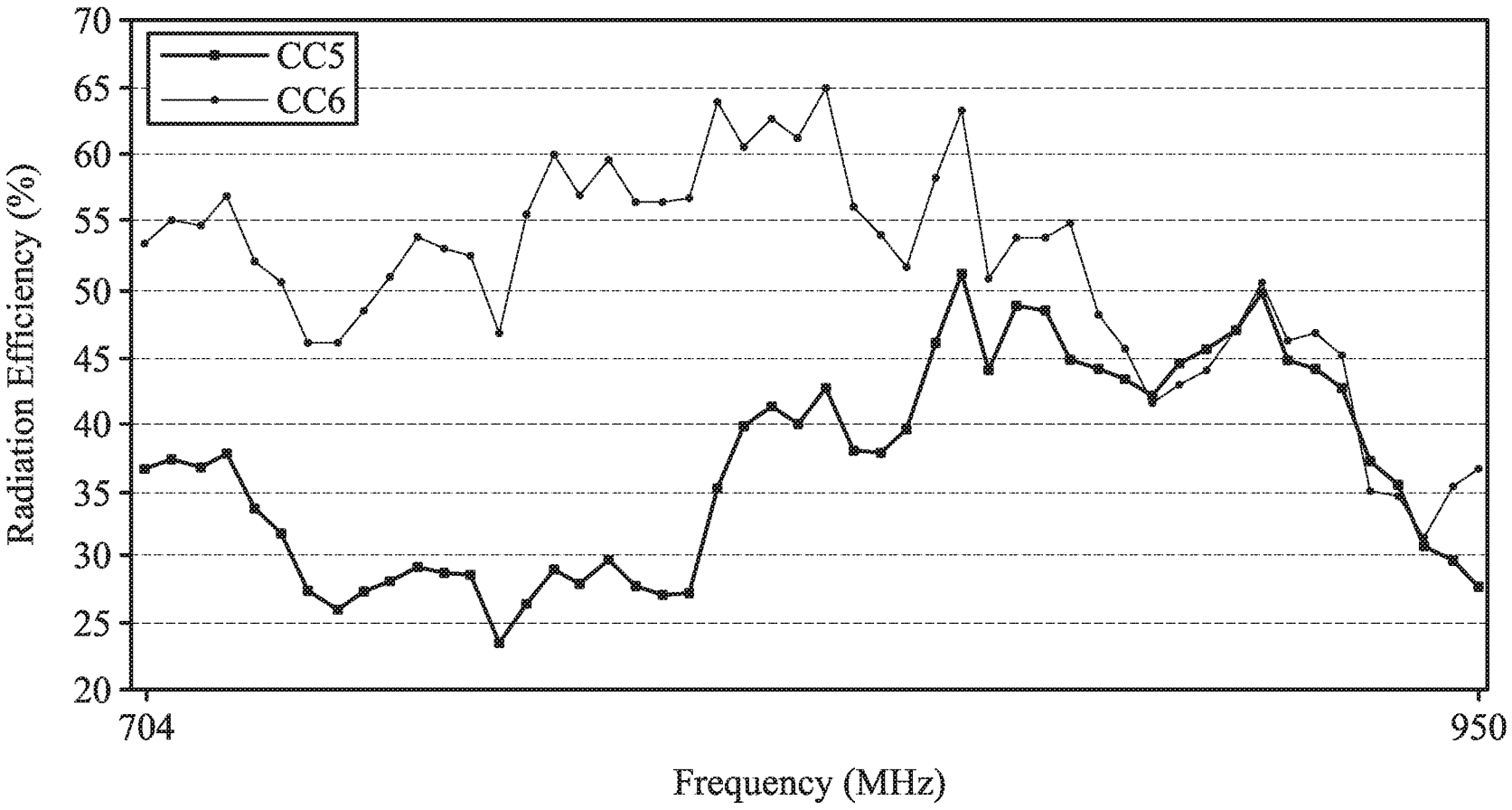
FIG. 5 is a diagram of radiation efficiency of an antenna structure operating in a low-frequency band according to an embodiment of the invention.

FIG. 5 is a diagram of radiation efficiency of the antenna structure 230 according to an embodiment of the invention. A fifth curve CC5 represents the radiation efficiency of the antenna structure 230 without the enclosed radiation element 250. A sixth curve CC6 represents the radiation efficiency of the antenna structure 230 with the enclosed radiation element 250. According to the measurements of FIG. 5, the incorporation of the enclosed radiation element 250 can increase the radiation efficiency of the antenna structure 230 by about 30%, so as to significantly improve the whole communication quality.

Figure 6:
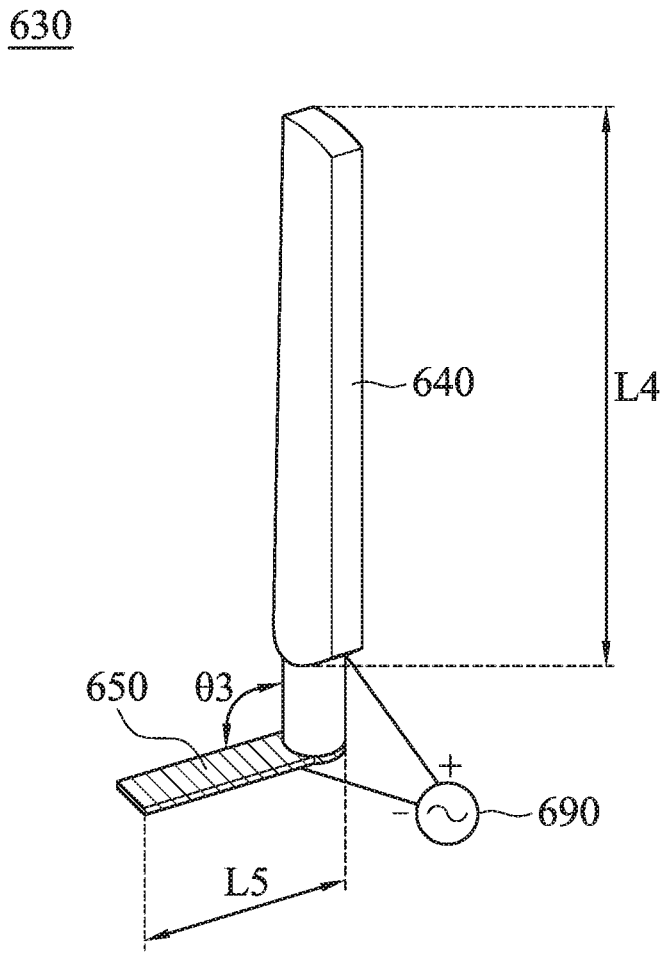
FIG. 6 is a view of an antenna structure according to another embodiment of the invention.

FIG. 6 is a view of an antenna structure 630 according to another embodiment of the invention. In the embodiment of FIG. 6, the antenna structure 630 includes an antenna body 640 and an enclosed radiation element 650. The antenna body 640 is directly coupled to a positive electrode of a signal source 690. The enclosed radiation element 650 is directly coupled to a negative electrode of the signal source 690. The antenna structure 630 covers a low-frequency band and a high-frequency band. The sum of the length L4 of the antenna body 640 and the length L5 of the enclosed radiation element 650 may be substantially equal to 0.4 wavelength of the low-frequency band of the antenna structure 630. (i.e., L4+L5=0.4λ). The angle θ3 between the antenna body 640 and the enclosed radiation element 650 may be substantially equal to 30, 45, or 75 degrees, or other degrees, and it is not limited to 90 degrees. According to practical measurements, even if the cable 120 is omitted, it may not negatively affect the radiation performance of the antenna structure 630. Other features of the antenna structure 630 of FIG. 6 are similar to those of the antenna structure 230 of FIG. 2. Therefore, the two embodiments can achieve similar levels of performance.

Figure 7:
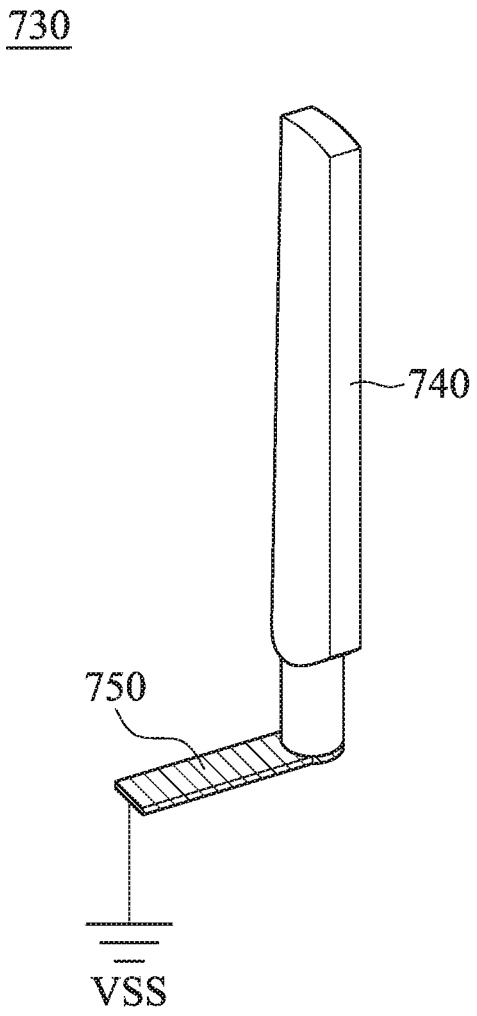
FIG. 7 is a view of an antenna structure according to another embodiment of the invention.

FIG. 7 is a view of an antenna structure 730 according to another embodiment of the invention. In the embodiment of FIG. 7, the antenna structure 730 includes an antenna body 740 and an enclosed radiation element 750. One end of the enclosed radiation element 750 is coupled to a ground voltage VSS. According to practical measurements, the enclosed radiation element 750 can provide different polarization directions for the antenna body 740, regardless of the enclosed radiation element 750 being coupled to or not coupled to the ground voltage VSS. Thus, the antenna structure 730 can have an almost omnidirectional radiation pattern. Other features of the antenna structure 730 of FIG. 7 are similar to those of the antenna structure 230 of FIG. 2. Therefore, the two embodiments can achieve similar levels of performance.

The invention proposes a novel communication device and a novel antenna structure. In comparison to conventional designs, the invention has at least the advantages of small size, multiple polarization directions, and almost omnidirectional radiation pattern. Therefore, the invention is suitable for application in a variety of indoor environments, so as to solve the problem of poor communication quality due to signal reflection and multipath fading in conventional designs.

Note that the above element sizes, element shapes, and frequency ranges are not limitations of the invention. An antenna designer can fine-tune these settings or values according to different requirements. It should be understood that the communication device and antenna structure of the invention are not limited to the configurations of FIGS. 1-7. The invention may merely include any one or more features of any one or more embodiments of FIGS. 1-7. In other words, not all of the features displayed in the figures should be implemented in the communication device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a nonconductive housing, having a hollow structure;

a signal source;

a cable, coupled to the signal source, and comprising a signaling conductor and a grounding conductor; and an antenna structure, comprising:

an antenna body, coupled to the signaling conductor, wherein the antenna body is disposed outside the nonconductive housing;

an enclosed radiation element, coupled to the grounding conductor, wherein the enclosed radiation element is disposed inside the nonconductive housing.

2. The communication device as claimed in claim 1, wherein the enclosed radiation element substantially has a straight-line shape.

3. The communication device as claimed in claim 1, wherein an angle between the antenna body and the enclosed radiation element is from 0 to 180 degrees.

4. The communication device as claimed in claim 1, wherein the antenna structure covers a low-frequency band and a high-frequency band, the low-frequency band is from 700 MHz to 960 MHz, and the high-frequency band is from 1700 MHz to 2700 MHz.

5. The communication device as claimed in claim 4, wherein a distance between the antenna body and the enclosed radiation element is shorter than or equal to 3 wavelengths of the low-frequency band.

6. The communication device as claimed in claim 4, wherein the antenna body comprises:

a connection radiation element, coupled to a positive feeding point;

a main radiation element, coupled to the connection radiation element;

a first meandering radiation element, coupled to a negative feeding point; and a second meandering radiation element, coupled to the negative feeding point;

wherein the connection radiation element is positioned between the first meandering radiation element and the second meandering radiation element.

7. The communication device as claimed in claim 6, wherein the connection radiation element, the first meandering radiation element, and the second meandering radiation element have a symmetrical pattern.

8. The communication device as claimed in claim 6, wherein the connection radiation element has a variable-width straight-line shape.

9. The communication device as claimed in claim 6, wherein the first meandering radiation element surrounds a first nonconductive region, and the second meandering radiation element surrounds a second nonconductive region.

10. The communication device as claimed in claim 6, wherein the main radiation element has an asymmetrical pattern.

11. The communication device as claimed in claim 6, wherein the main radiation element has a rectangular notch.

12. The communication device as claimed in claim 6, wherein a length of the antenna body is substantially equal to 0.25 wavelength of the low-frequency band.

13. The communication device as claimed in claim 6, wherein a length of the enclosed radiation element is greater than 3 times a width of the antenna body.

14. The communication device as claimed in claim 6, wherein a length of the antenna body is greater than 7 times a width of the antenna body.

15. The communication device as claimed in claim 6, wherein a sum of a length of the antenna body and a length of the enclosed radiation element is substantially equal to 0.4 wavelength of the low-frequency band.

16. The communication device as claimed in claim 6, wherein a sum of a length of the main radiation element and a length of the enclosed radiation element is substantially equal to 0.6 wavelength of the high-frequency band.

17. The communication device as claimed in claim 1, wherein the antenna body is classified as a folded dipole antenna.

18. The communication device as claimed in claim 1, wherein the antenna structure further comprises:

a connector, wherein the cable is coupled through the connector to the antenna body and the enclosed radiation element.

19. The communication device as claimed in claim 1, wherein the antenna structure further comprises:

a nonconductive antenna cover, wherein the antenna body is disposed inside the nonconductive antenna cover.

20. An antenna structure, comprising:

an antenna body, coupled to a positive electrode of a signal source; and an enclosed radiation element, coupled to a negative electrode of the signal source;

wherein the antenna structure covers a low-frequency band and a high-frequency band;

wherein a sum of a length of the antenna body and a length of the enclosed radiation element is substantially equal to 0.4 wavelength of the low-frequency band.

* * * * *